US008800994B2

(12) United States Patent
Pavlovic

(10) Patent No.: US 8,800,994 B2
(45) Date of Patent: Aug. 12, 2014

(54) THREE-DIMENSIONAL JIGSAW PUZZLE

(71) Applicant: Great Circle Works Inc., Oakville (CA)

(72) Inventor: Marko Pavlovic, Zagreb (HR)

(73) Assignee: Great Circle Works Inc., Oakville (CA)

( * ) Notice: Subject to any disclaimer, the term of this patent is extended or adjusted under 35 U.S.C. 154(b) by 0 days.

(21) Appl. No.: 13/662,714

(22) Filed: Oct. 29, 2012

(65) Prior Publication Data

US 2014/0117619 A1 May 1, 2014

(51) Int. Cl.
*A63F 9/08* (2006.01)

(52) U.S. Cl.
USPC ..... 273/156; 273/157 R; 273/160

(58) Field of Classification Search
USPC ..... 273/156, 157 R, 160, 153 P, 290; 446/117, 118; D21/479
See application file for complete search history.

(56) References Cited

U.S. PATENT DOCUMENTS

| | | | | | |
|---|---|---|---|---|---|
| 121,936 | A | * | 12/1871 | Fisher | 446/117 |
| 535,535 | A | * | 3/1895 | Gardner | 273/294 |
| 1,886,109 | A | * | 11/1932 | Lenfant | 273/157 R |
| 2,493,697 | A | * | 1/1950 | Raczkowski | 273/156 |
| 2,610,856 | A | * | 9/1952 | Welty | 273/160 |
| 2,694,265 | A | * | 11/1954 | Way | 273/160 |
| 3,720,008 | A | * | 3/1973 | Hutar | 434/430 |
| 3,765,121 | A | | 10/1973 | Vennola | |
| D243,783 | S | * | 3/1977 | Kleinman et al. | D21/479 |
| 4,040,630 | A | * | 8/1977 | Brattain | 273/157 R |
| 4,357,016 | A | | 11/1982 | Allison | |
| 4,360,347 | A | * | 11/1982 | Ghaznavi | 434/198 |
| 4,378,116 | A | | 3/1983 | Rubik | |
| D275,022 | S | * | 8/1984 | Simpson et al. | D21/478 |
| 4,826,171 | A | * | 5/1989 | Morse | 273/160 |
| 4,874,176 | A | * | 10/1989 | Auerbach | 273/157 R |
| 4,934,701 | A | * | 6/1990 | Ting | 273/157 R |
| 5,611,544 | A | | 3/1997 | Grebler et al. | |
| 6,022,026 | A | | 2/2000 | Johnson, III | |
| 6,692,001 | B2 | * | 2/2004 | Romano | 273/156 |
| 7,311,306 | B2 | | 12/2007 | Chuang | |
| D599,416 | S | * | 9/2009 | Turco-Rivas | D21/479 |
| 8,181,961 | B1 | | 5/2012 | Hall | |

FOREIGN PATENT DOCUMENTS

| | | | |
|---|---|---|---|
| CH | 604792 | A * | 9/1978 |
| DE | 20000570 | U1 * | 9/2000 |

OTHER PUBLICATIONS http://en.wikipedia.org/wiki/Polycube—POLYCUBE (last visited Apr. 23, 2013).

* cited by examiner

*Primary Examiner* — Steven Wong
(74) *Attorney, Agent, or Firm* — Simpson & Simpson, PLLC

(57) ABSTRACT

A three-dimensional jigsaw puzzle comprising a base, a post fixedly secured to and emanating upwardly from the base, a first group of pieces, where each piece in the first group has a through-bore to enable stacking about the post and also has at least one radially extending projection in a shape of a trapezoidal solid, and a second group of pieces, where each piece in the second group has at least one radially extending projection in the shape of a trapezoidal solid. The first and second groups of pieces are operatively arranged to stack and interlock with one another to form a cylindrically shaped structure.

26 Claims, 12 Drawing Sheets

THREE-DIMENSIONAL JIGSAW PUZZLE

FIELD OF THE INVENTION

The invention relates generally to puzzles, and, more particularly, to three-dimensional puzzles having stackable geometrically shaped pieces.

BACKGROUND OF THE INVENTION

Puzzles exist that require assembling, stacking, logic, math and fine motor skills. Generally, jigsaw puzzles require the assembly of numerous small, often oddly shaped, interlocking and tessellating pieces. Both two dimensional and three-dimensional jigsaw puzzles are known in the art. Jigsaw puzzles, both two dimensional and three-dimensional are known to have a single solution. Other puzzles are characterized by having a predetermined specific sequence of movements as the only solution.

One such puzzle is disclosed in U.S. Pat. No. 4,357,016 (Allison) which reveals a manipulation puzzle comprising a plurality of ring members to form a cylinder about a plurality of longitudinal slide members forming an interior cylinder on a common axis with the ring members. The solution is programmed into the elements by a series of pegs on one set of members and a cooperative set of grooves on the other set of members. The puzzle is solved by manipulating the components through a specific sequence of movements, in a predetermined order, in accordance with a code employed in the construction of the puzzle. This reference fails to disclose a puzzle having inner and outer pieces which stack directly with each other vertically and radially.

Another type of puzzle is disclosed in U.S. Pat. No. 3,765,121 (Vennola) where the puzzle is a stacking toy with inner and outer stacking components. The stacking puzzle disclosed comprises an elongated hollow cylinder having a longitudinal slot, a plurality of disks proportioned to be slidably fit within the cylinder in stacked arrangement, and a plurality of rings proportioned to be slidably fit over the cylinder in stacked arrangement. The disks and rings are identical in shape and interchangeable. This reference fails to disclose a puzzle having inner and outer pieces which stack directly with each other vertically and radially.

U.S. Pat. No. 7,311,306 (Chuang) discloses an extendable cylindrical jigsaw puzzle having a plurality of pieces, frames for the top and bottom edges to increase stability, and an optional cap that is mountable on top of the top rim such that the cylindrical jigsaw puzzle is able to extend its application. For example, a user can use the cylindrical structure disclosed in Chuang as a moneybox, or a pen container. This reference fails to disclose a puzzle having a solid cylindrical structure and inner and outer pieces which stack directly with each other vertically and radially.

U.S. Pat. No. 6,692,001 (Romano) discloses a three-dimensional multi-layered decorative puzzle apparatus comprising an innermost layer and an outermost layer constructed into a three-dimensional cylindrical structure. Each layer further includes a set of innermost and outermost puzzle pieces and the apparatus includes a base with an elongated rod securely attached to the center of the base. The innermost puzzle pieces are seated upon the rod and the outermost pieces are seated upon the innermost pieces. The constructed geometric structure sits upon the top surface of the base. The innermost layer and the outermost layer are arranged into a predetermined geometric shape forming a geometric structure. Further, Romano discloses that each innermost piece sits upon the mid-section of the rod and that each outermost piece sits upon the back of each innermost piece. This reference discloses a large number of pieces resulting in a high chance that at least one piece will be lost. Additionally, this reference fails to disclose a puzzle having inner and outer pieces which stack directly with each other vertically and radially.

U.S. Pat. No. 5,611,544 (Grebler et al.) discloses a three-dimensional stackable game comprising a plurality of substantially similar rectangular bricks arranged in layers to form a collapsible tower, with the orientation of the rectangular bricks alternating from one layer to the next to provide frictional coupling between layers and adjacent bricks in the same layer. During play, the height of the tower is increased by removing bricks from one or more lower layers to build successive upper layers. The game ends when the tower collapses because a brick has been removed. This reference fails to disclose a puzzle having inner and outer pieces which stack directly with each other vertically and radially.

Therefore, there is a long-felt need for a three-dimensional puzzle having a small number of pieces and a large number of solutions. There is also a long-felt need for a three-dimensional puzzle having degrees of complexity which can be changed according to the preference of the user. Finally, there is a long-felt need for a three-dimensional puzzle having two sets of pieces that must be arranged vertically and radially to solve a large number of solutions having varying degrees of difficulty.

BRIEF SUMMARY OF THE INVENTION

The invention is a three-dimensional jigsaw puzzle comprising a base, a post fixedly secured to and emanating upwardly from the base, a first group of pieces, where each piece in the first group has a through-bore to enable stacking about the post and also has at least one radially extending projection in a shape of a trapezoidal solid, and a second group of pieces, where each piece in the second group has at least one radially extending projection in the shape of a trapezoidal solid. The first and second groups of pieces are operatively arranged to stack and interlock with one another to form a cylindrically shaped structure. In a preferred embodiment the fully formed cylindrically shaped structure has no gaps between pieces. The fully formed cylindrically shaped structure can be two, three, four or five levels high in a preferred embodiment.

The object of the subject invention is to provide a new type of puzzle, the completing of which helps develop problem solving, logical thinking, and concentration skills.

A further object of this invention is to provide a puzzle which offers varying levels of complexity in completing the puzzle, without changing the concept upon which the three-dimensional puzzle is based.

Another object of the subject invention is to provide a puzzle having a large number of solutions and a relatively low number of puzzle pieces.

A further object of the invention is to provide a puzzle having an innermost set of pieces and an outermost set of pieces which stack about and on top of the innermost set of pieces to form what appears to be a solid cylindrical structure having no gaps between the pieces.

These and other objects and advantages of the present invention will be readily appreciable from the following description of preferred embodiments of the invention and from the accompanying drawings and claims.

BRIEF DESCRIPTION OF THE DRAWINGS

The nature and mode of operation of the present invention will now be more fully described in the following detailed description of the invention taken with the accompanying figures, in which:

FIG. 2-1 is a perspective view of the first ring-like unit of the first group of pieces;

FIG. 2-1-1 is a top down perspective view of a trapezoidal projection isolated from the first ring-like unit;

FIG. 2-1-2 is a bottom up perspective view of a trapezoidal projection isolated from the first ring-like unit;

FIG. 2-1-3 is a side elevational view of a trapezoidal projection isolated from the first ring-like unit;

FIG. 2-1-4 is a side elevational view of a trapezoidal projection isolated from the first ring-like unit;

FIG. 2-1-5 is a side elevational view of a trapezoidal projection isolated from the first ring-like unit;

FIG. 2-1-6 is a side elevational view of a trapezoidal projection isolated from the first ring-like unit;

FIG. 2-1-7 is a top plan view of a trapezoidal projection isolated from the first ring-like unit;

FIG. 2-1-8 is a bottom plan view of a trapezoidal projection isolated from the first ring-like unit;

FIG. 2-2 is a perspective view of the second ring-like unit of the first group of pieces;

FIG. 2-3 is a perspective view of the third ring-like unit of the first group of pieces;

FIG. 2-4 is a perspective view of the fourth ring-like unit of the first group of pieces;

FIG. 2-5 is a perspective view of the fifth ring-like unit of the first group of pieces;

FIG. 3-1 is a side view of the first curved unit of the second group of pieces;

FIG. 3-2 is a side view of the second curved unit of the second group of pieces;

FIG. 3-3 is a side view of the third curved unit of the second group of pieces;

FIG. 3-4 is a side view of the fourth curved unit of the second group of pieces;

FIG. 3-5 is a side view of the fifth curved unit of the second group of pieces;

FIG. 3-6 is a side view of the sixth curved unit of the second group of pieces;

FIG. 3-7 is a side view of the seventh curved unit of the second group of pieces;

FIG. 3-8 is a side view of the eighth curved unit of the second group of pieces;

FIG. 3-9 is a side view of the ninth curved unit of the second group of pieces;

FIG. 3-10 is a side view of the tenth curved unit of the second group of pieces;

FIG. 3-11 shows grid G which illustrates the spatial arrangement of trapezoidal blocks within the puzzle;

FIG. 4-1 is a side view of the invention showing the base, post and the first group of pieces where the ring-like units are stacked on top of one another about the post;

FIG. 4-2 is a perspective view of the invention showing the base, post and the first group of pieces where the ring-like units are stacked on top of one another about the post;

FIG. 4-3 is a top view of the invention showing the base, post and the first group of pieces where the ring-like units are stacked on top of one another about the post;

FIG. 5 is a perspective view of the three-dimensional puzzle showing a partially completed solution;

FIG. 6 is a perspective view of the three-dimensional puzzle showing a partially completed solution;

FIG. 7 is a perspective view of the three-dimensional puzzle showing a completed two-layer solution;

FIG. 8 is a perspective view of the three-dimensional puzzle showing a completed three-layer solution;

FIG. 9 is a perspective view of the three-dimensional puzzle showing a completed four-layer solution; and, FIG. 10 is a perspective view of the three-dimensional puzzle showing a completed five-layer solution.

DETAILED DESCRIPTION OF THE INVENTION

At the outset, it should be appreciated that like drawing numbers on different drawing views identify identical, or functionally similar, structural elements of the invention. While the present invention is described with respect to what is presently considered to be the preferred aspects, it is to be understood that the invention as claimed is not limited to the disclosed aspect. The present invention is intended to include various modifications and equivalent arrangements within the spirit and scope of the appended claims.

Furthermore, it is understood that this invention is not limited to the particular methodology, materials and modifications described and as such may, of course, vary. It is also understood that the terminology used herein is for the purpose of describing particular aspects only, and is not intended to limit the scope of the present invention, which is limited only by the appended claims.

Unless defined otherwise, all technical and scientific terms used herein have the same meaning as commonly understood to one of ordinary skill in the art to which this invention belongs. Although any methods, devices or materials similar or equivalent to those described herein can be used in the practice or testing of the invention, the preferred methods, devices, and materials are now described.

Structure

Figure 1:
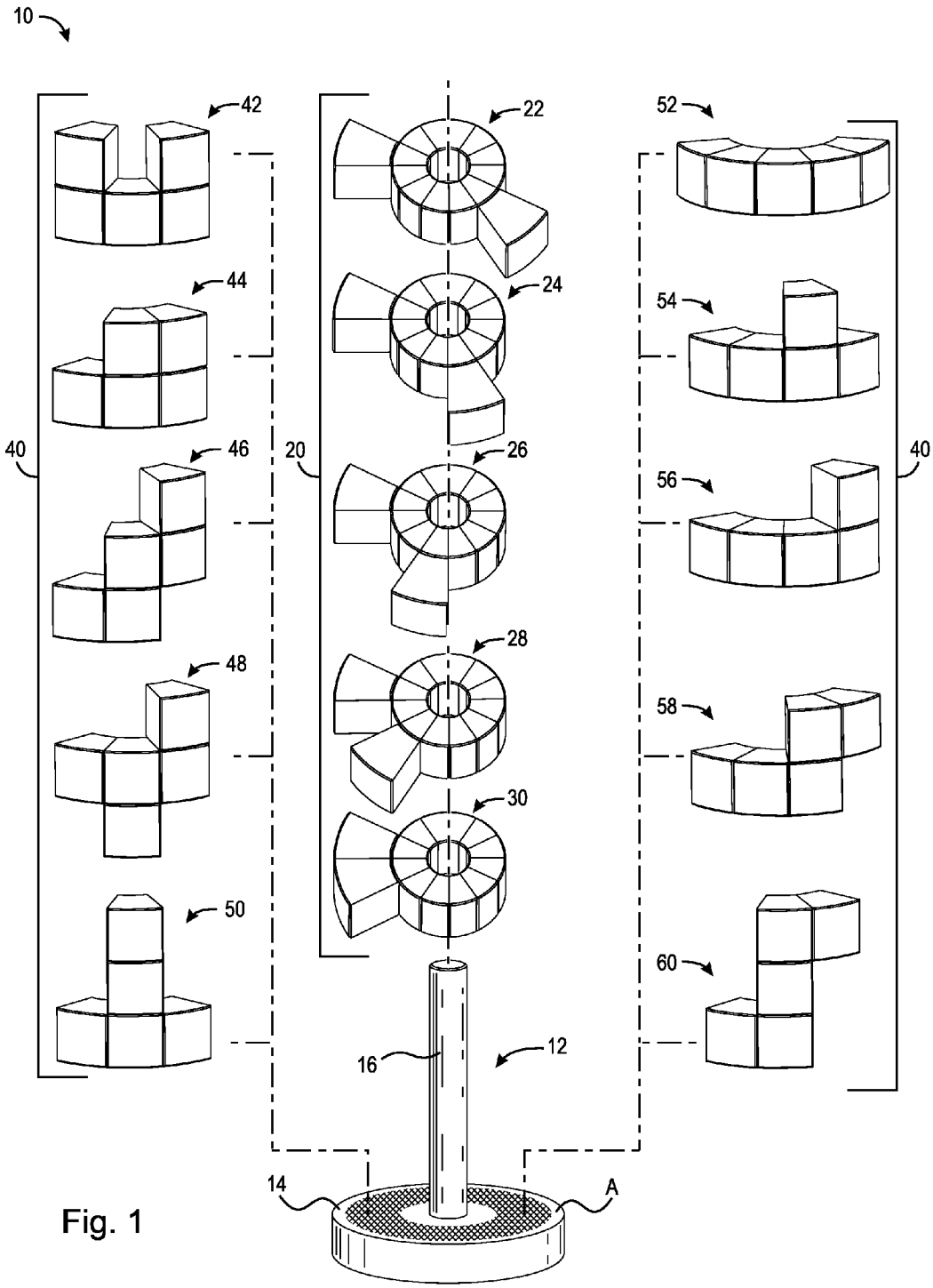
FIG. 1 is a partial exploded perspective view of the invention showing the base, post, first group of pieces, and second group of pieces.

Adverting now to the Figures, FIG. 1 shows a partial exploded perspective of three-dimensional puzzle 10 of the invention. Three-dimensional puzzle 10 comprises base 12, post 16, first group of pieces 20 and second group of pieces 40. In a preferred embodiment, base 12 is disk-shaped and comprises top surface 14. It should be appreciated that base 12 can be any flat surface having any shape such as, a square, rectangle, or a triangle so long as top surface 14 has sufficient surface area to support the size and shape of three-dimensional puzzle 10 of the invention. In a preferred embodiment, base 12 is made of wood but, it should be appreciated that base 12 can be made of any material, solid or otherwise, such as, for example, ABS plastic. Post 16 is cylindrical and fixedly secured to the center of top surface 14 of base 12. Post 16 extends upwardly from the center of top surface 14 of base 12. In a preferred embodiment, the top circumference of post 16 is chamfered as described herein. In a preferred embodiment, post 16 is made of wood but, it should be appreciated to a person having ordinary skill in the art that post 16 can be made of any material, solid or otherwise, such as, for example, plastic or glass. First group of pieces 20 and second group of pieces 40 are shown disposed above and around base 12 and post 16. First group of pieces 20 comprises five ring-like units to be described below. Second group of pieces 40 comprises ten curved units to be described below.

First group of pieces 20 and second group of pieces 40, when stacked about each other rest on portion A of top surface 14 of base 12. Portion A has a shape that is similar to top surface 14 but portion A is smaller than top surface 14.

Figures 1, 2:
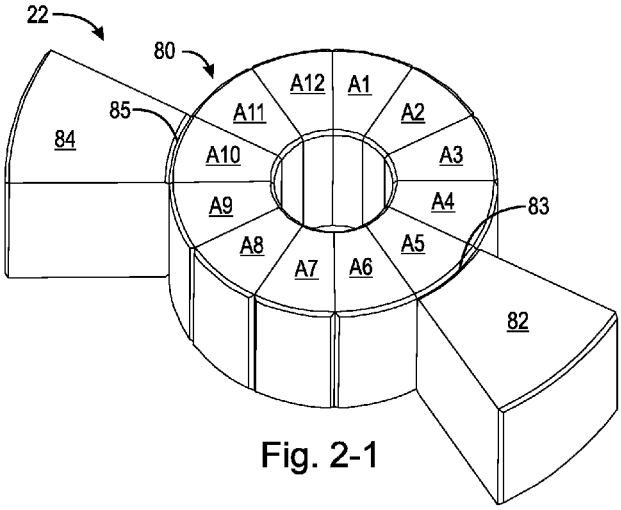

FIG. 2-1 shows first ring-like unit 22, which is also shown in FIG. 1 as the topmost ring-like unit of first group of pieces 20. First ring-like unit 22 comprises first ring 80, first trapezoidal projection 82, and second trapezoidal projection 84. First ring 80 comprises twelve trapezoidal solids A1, A2, A3, A4, A5, A6, A7, A8, A9, A10, A11, A12 which are substantially similar to one another in shape. In a preferred embodiment, trapezoidal solids A1, A2, A3, A4, A5, A6, A7, A8, A9, A10, A11, A12 are shaped as trapezoidal solids. For clarity, first ring 80 is situated as a clock face and the numbering of trapezoidal solids A1, A2, A3, A4, A5, A6, A7, A8, A9, A10, A11, A12 starts at noon. It should be appreciated that the numbering could start anywhere along first ring 80. Trapezoidal solid A1 has six sides, four of which are planar and two of which are arcuate. As shown in FIG. 2-1, the outermost and innermost sides of trapezoidal solid A1 are arcuate and the outermost arcuate side is longer than the innermost arcuate side. The innermost arcuate side of trapezoidal solid A1 is concave and operatively arranged to slidingly engage with post 16. The outermost arcuate side of trapezoidal solid A1 is convex and operatively arranged to engage with either first trapezoidal projection 82 or second trapezoidal projection 84. The structure of trapezoidal solid A1 is identical to the structure of trapezoidal solids A2, A3, A4, A5, A6, A7, A8, A9, A10, A11, A12. Each trapezoidal solid A1, A2, A3, A4, A5, A6, A7, A8, A9, A10, A11, A12 represents 30 degrees of first ring 80 which is circular. Trapezoidal solids A1, A2, A3, A4, A5, A6, A7, A8, A9, A10, A11, A12 may be fixedly secured to each other along two opposing planar sides of each. Or, trapezoidal solids A1, A2, A3, A4, A5, A6, A7, A8, A9, A10, A11, A12 can be removably secured to each other. In one embodiment, trapezoidal solids A1, A2, A3, A4, A5, A6, A7, A8, A9, A10, A11, A12 are formed of a single piece of material and each trapezoidal solid is marked with chamfered channels only on the outermost arcuate surfaces of first ring 80. In a preferred embodiment, trapezoidal solids A1, A2, A3, A4, A5, A6, A7, A8, A9, A10, A11, A12 have lines demarcating each trapezoidal solid from other trapezoidal solids.

First trapezoidal projection 82 and second trapezoidal projection 84, as shown in FIG. 2-1, are substantially similar in shape to trapezoidal solids A1, A2, A3, A4, A5, A6, A7, A8, A9, A10, A11, A12. First trapezoidal projection 82 and second trapezoidal projection 84 have six sides each, four of which are planar and two of which are arcuate. The outermost and innermost sides of first trapezoidal projection 82 are arcuate. The outermost and innermost sides of second trapezoidal projection 84 are arcuate. First trapezoidal projection 82 and second trapezoidal projection 84 are larger in proportions than trapezoidal solids A1, A2, A3, A4, A5, A6, A7, A8, A9, A10, A11, A12. As shown in FIG. 2-1, first and second trapezoidal projections 82 and 84 extend outwardly radially from trapezoidal solids A1, A2, A3, A4, A5, A6, A7, A8, A9, A10, A11, A12. The innermost arcuate side of first trapezoidal projection 82 is fixedly secured to the outermost arcuate side of trapezoidal solid A5. Chamfered edge 83 is shown along the top of the innermost arcuate side of first trapezoidal projection 82 and abuts the outermost arcuate side of trapezoidal solid A5. The innermost arcuate side of second trapezoidal projection 84 is fixedly secured to the outermost arcuate side of trapezoidal solid A10. Chamfered edge 85 is shown along the top of the innermost arcuate side of second trapezoidal projection 84 and abuts the outermost arcuate side of trapezoidal solid A10. In a preferred embodiment, the chamfered edges are chamfered by 0.5 to 1 mm at approximately a 45 degree angle. All chamfered edges referred to herein are substantially similar in a preferred embodiment but, it should be appreciated that chamfer could be modified. Chamfered edges create grooves which help a user orient while building three-dimensional jigsaw puzzle 10. It should be appreciated that first trapezoidal projection 82 and second trapezoidal projection 84 can also be operatively arranged to be removably secured to their respective trapezoidal solids. It should be appreciated to a person having ordinary skill in the art that trapezoidal solids A1, A2, A3, A4, A5, A6, A7, A8, A9, A10, A11, A12, first trapezoidal projection 82 and second trapezoidal projection 84 are preferably made of wood but, can also be made of plastic or any other stackable material such as, glass.

The following FIGS. (2-1-1 to 2-1-8) explain in more detail the shape of trapezoidal solid A1 and trapezoidal projections 82 and 84. FIG. 2-1-1 shows a top down perspective view of second trapezoidal projection 84 isolated from first ring-like unit 22. From this view, second trapezoidal projection 84 comprises top side 240, first planar side 200, inner arcuate side 220, and outer arcuate side 230. Top side 240 is a planar trapezoidal surface having two angled straight borders and two circular borders. Both circular borders are chamfered. First planar side 200 is a planar rectangular surface that has two longer sides which are horizontal and two shorter sides which are vertical. Both shorter sides are chamfered. Inner and outer arcuate sides 220 and 230 are portions of a ring and inner arcuate side 220 is smaller than outer arcuate side 230.

FIG. 2-1-2 shows a bottom up perspective of second trapezoidal projection 84 isolated from first ring-like unit 22. Second trapezoidal projection 84 comprises bottom side 250, second planar side 210, inner arcuate side 220, and outer arcuate side 230. Bottom side 250 is substantially similar to top side 240 and second planar side 210 is substantially similar to first planar side 200.

Figures 1, 2, 5:
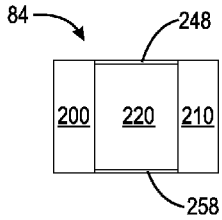
Figures 1, 2, 6:
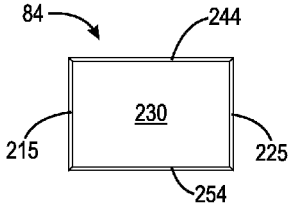
Figures 1, 2:
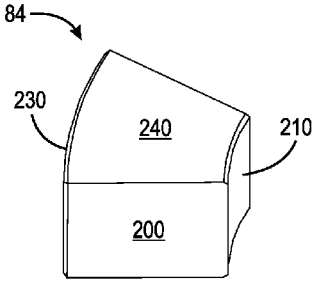
Figures 1, 2, 3:
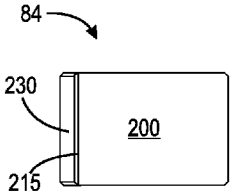

FIG. 2-1-3 shows a side elevational view of second trapezoidal projection 84, which illustrates first planar side 200, chamfered edge 215, and outer arcuate side 230. Chamfered edge 215 is operatively arranged along the curved upward border between first planar side 200 and outer arcuate side 230. FIG. 2-1-4 shows the opposite side elevational view of second trapezoidal projection 84 which depicts second planar side 210, chamfered edge 225, and outer arcuate side 230. Chamfered edge 225 is operatively arranged along the curved upward border between second planar side 210 and outer arcuate side 230.

FIG. 2-1-5 depicts the side elevational view of second trapezoidal projection 84 which shows inner arcuate side 220 and first and second planar sides 200 and 210. First and second planar sides 200 and 210 protrude outwardly from inner arcuate side 220. The vertical borders between inner arcuate side 220 and first and second planar sides 200 and 210 are chamfered. FIG. 2-1-6 depicts the opposite side elevational view of second trapezoidal projection 84 which shows outer arcuate side 230. From this view, the other sides of second trapezoidal projection 84 are not visible.

Figures 1, 2, 7:
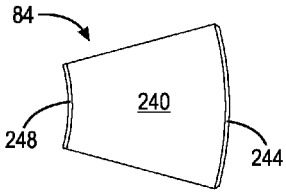
Figures 1, 2:
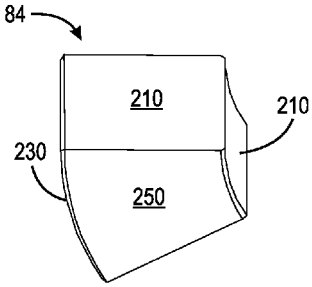
Figures 1, 2, 4:
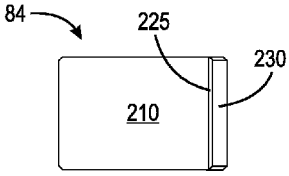
Figures 1, 2, 8:
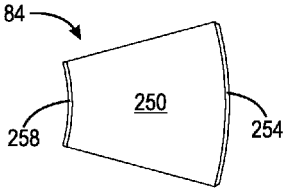
Figure 2:
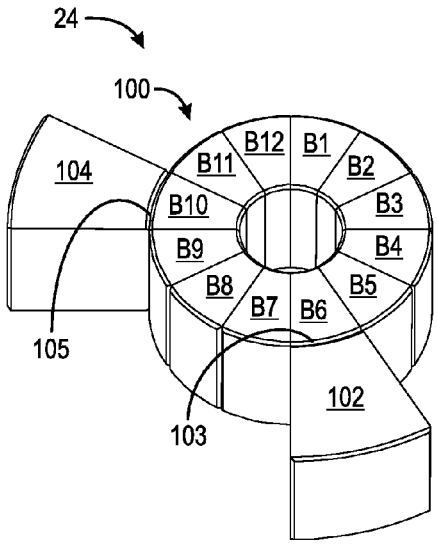
Figures 2, 3:
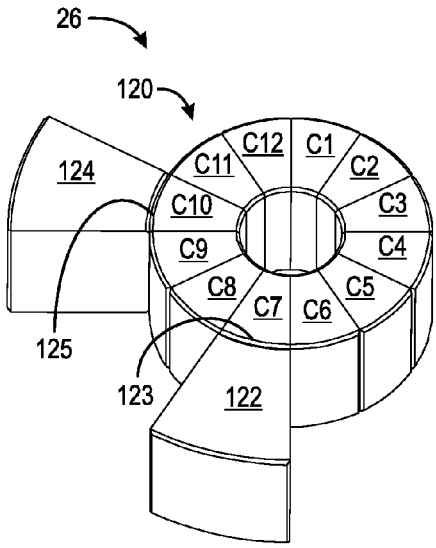
Figures 2, 3, 4:
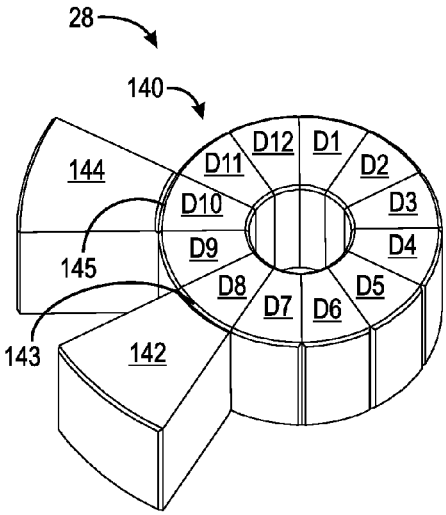
Figures 2, 3, 4, 5:
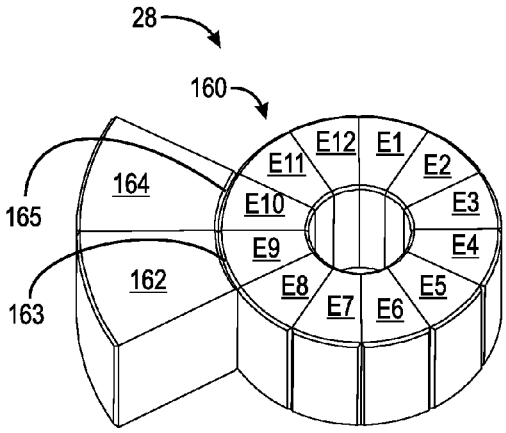

FIG. 2-1-7 is an illustration of a top plan view of second trapezoidal projection 84 showing top side 240 and chamfered edges 244 and 248 which are curved. FIG. 2-1-8 illustrates a bottom plan view of second trapezoidal projection 84 showing bottom side 250 and chamfered edges 254 and 258 which are similarly curved.

Second trapezoidal projection 84 represents all other trapezoidal projections of the invention as well as all trapezoidal blocks to be discussed below. Additionally, second trapezoidal projection 84 represents a larger version of all trapezoidal solids discussed herein.

FIG. 2-2 shows second ring-like unit 24, which is also shown in FIG. 1 as the second topmost ring-like unit of first group of pieces 20. Second ring-like unit 24 comprises second ring 100, first trapezoidal projection 102, and second trapezoidal projection 104. Second ring 100, as first ring 80, comprises twelve equivalent trapezoidal solids B1, B2, B3, B4, B5, B6, B7, B8, B9, B10, B11, B12. Again, for clarity, second ring 100 is situated as a clock face and the numbering of trapezoidal solids B1, B2, B3, B4, B5, B6, B7, B8, B9, B10, B11, B12 starts at noon. It should be appreciated that the numbering could start anywhere along second ring 100. Like trapezoidal solid A1, trapezoidal solids B, B2, B3, B4, B5, B6, B7, B8, B9, B10, B11, B12 have six sides each, four of which are planar and two of which are arcuate. The innermost arcuate sides of trapezoidal solids B1, B2, B3, B4, B5, B6, B7, B8, B9, B10, B11, and B12 are concave to engage with post 16. The outermost arcuate sides of trapezoidal solids B1, B2, B3, B4, B5, B6, B7, B8, B9, B10, B11, and B12 are convex and operatively arranged to engage with either first trapezoidal projection 102 or second trapezoidal projection 104. The structure of trapezoidal solids B1, B2, B3, B4, B5, B6, B7, B8, B9, B10, B11, and B12 is identical to the structure of trapezoidal solids A1, A2, A3, A4, A5, A6, A7, A8, A9, A10, A11, A12. Each trapezoidal solid B1, B2, B3, B4, B5, B6, B7, B8, B9, B10, B11, B12 represents 30 degrees of second ring 100, which is circular. Like trapezoidal solids A1, A2, A3, A4, A5, A6, A7, A8, A9, A10, A11, A12, trapezoidal solids B1, B2, B3, B4, B5, B6, B7, B8, B9, B10, B11, and B12 may be fixedly secured to each other along two opposing planar sides of each. Or, trapezoidal solids B, B2, B3, B4, B5, B6, B7, B8, B9, B10, B11, and B12 can be removably secured to each other. As described above, like trapezoidal solids A, A2, A3, A4, A5, A6, A7, A8, A9, A10, A11, A12, in a preferred embodiment, trapezoidal solids B1, B2, B3, B4, B5, B6, B7, B8, B9, B10, B11, and B12 are formed of a single piece of material and each trapezoidal solid is marked with chamfered channels only on the outermost arcuate surfaces of second ring 100.

First trapezoidal projection 102 and second trapezoidal projection 104, as shown in FIG. 2-2, are substantially similar in shape to first and second trapezoidal projections 82 and 84. First trapezoidal projection 102 is fixedly secured to the outermost arcuate side of trapezoidal solid B6. Second trapezoidal projection 104 is fixedly secured to the outermost arcuate side of trapezoidal solid B10. Chamfered edge 103 is shown along the top of the innermost arcuate side of first trapezoidal projection 102. Chamfered edge 105 is shown along the top of the innermost arcuate side of second trapezoidal projection 104.

FIG. 2-3 shows third ring-like unit 26, which is also shown in FIG. 1 as the third topmost ring-like unit of first group of pieces 20. Third ring-like unit 26 comprises third ring 120, first trapezoidal projection 122, and second trapezoidal projection 124. Third ring 120, as first and second rings 80 and 100, comprises twelve equivalent trapezoidal solids C1, C2, C3, C4, C5, C6, C7, C8, C9, C10, C11, and C12 which are equivalent to trapezoidal solids A1, A2, A3, A4, A5, A6, A7, A8, A9, A10, A11, A12, B1, B2, B3, B4, B5, B6, B7, B8, B9, B10, B11, and B12. Again, for clarity, third ring 120 is situated as a clock face and the numbering of trapezoidal solids C1, C2, C3, C4, C5, C6, C7, C8, C9, C10, C11, and C12 starts at noon. It should be appreciated that the numbering could start anywhere along third ring 120. Each trapezoidal solid C1, C2, C3, C4, C5, C6, C7, C8, C9, C10, C11, and C12 represents 30 degrees of third ring 120 which is circular. Trapezoidal solids C1, C2, C3, C4, C5, C6, C7, C8, C9, C10, C11, and C12 are formed of a single piece of material and each trapezoidal solid is marked with chamfered channels only on the outermost arcuate surfaces of third ring 120.

First trapezoidal projection 122 and second trapezoidal projection 124, as shown in FIG. 2-3, are substantially similar in shape to first and second trapezoidal projections 82, 84, 102, and 104. First trapezoidal projection 122 is fixedly secured to the outermost arcuate side of trapezoidal solid C7. Second trapezoidal projection 124 is fixedly secured to the outermost arcuate side of trapezoidal solid C10. Chamfered edge 123 is shown along the top of the innermost arcuate side of first trapezoidal projection 122. Chamfered edge 125 is shown along the top of the innermost arcuate side of second trapezoidal projection 124.

FIG. 2-4 shows fourth ring-like unit 28, which is also shown in FIG. 1 as the fourth topmost ring-like unit of first group of pieces 20. Fourth ring-like unit 28 comprises fourth ring 140, first trapezoidal projection 142, and second trapezoidal projection 144. Fourth ring 140, as first, second, and third rings 80, 100, and 120, comprises twelve equivalent trapezoidal solids D1, D2, D3, D4, D5, D6, D7, D8, D9, D10, D11, and D12 which are substantially similar to trapezoidal solids A1, A2, A3, A4, A5, A6, A7, A8, A9, A10, A11, A12, B1, B2, B3, B4, B5, B6, B7, B8, B9, B10, B11, B12, C1, C2, C3, C4, C5, C6, C7, C8, C9, C10, C11, and C12. Again, fourth ring 140 is situated as a clock face and the numbering of trapezoidal solids D1, D2, D3, D4, D5, D6, D7, D8, D9, D10, D11, and D12 starts at noon. It should be appreciated that the numbering could start anywhere along fourth ring 140. Each trapezoidal solid D1, D2, D3, D4, D5, D6, D7, D8, D9, D10, D11, and D12 represents 30 degrees of fourth ring 140 which is circular. Trapezoidal solids D1, D2, D3, D4, D5, D6, D7, D8, D9, D10, D11, and D12 are formed of a single piece of material and each trapezoidal solid is marked with chamfered channels only on the outermost arcuate surfaces of fourth ring 140.

First trapezoidal projection 142 and second trapezoidal projection 144, as shown in FIG. 2-4, are substantially similar in shape to first and second trapezoidal projections 82, 84, 102, 104, 124, and 144. First trapezoidal projection 142 is fixedly secured to the outermost arcuate side of trapezoidal solid D8. Second trapezoidal projection 144 is fixedly secured to the outermost arcuate side of trapezoidal solid D10. Chamfered edge 143 is shown along the top of the innermost arcuate side of first trapezoidal projection 142. Chamfered edge 145 is shown along the top of the innermost arcuate side of second trapezoidal projection 144.

FIG. 2-5 shows fifth ring-like unit 30, which is also shown in FIG. 1 as the bottommost ring-like unit of first group of pieces 20. Fifth ring-like unit 30 comprises fifth ring 160, first trapezoidal projection 162, and second trapezoidal projection 164. Fifth ring 160, as first, second, third, and fourth rings 80, 100, 120, and 140 comprises twelve equivalent trapezoidal solids E1, E2, E3, E4, E5, E6, E7, E8, E9, E10, E11, and E12 which are substantially similar to trapezoidal solids A1, A2, A3, A4, A5, A6, A7, A8, A9, A10, A11, A12, B1, B2, B3, B4, B5, B6, B7, B8, B9, B10, B11, B12, C1, C2, C3, C4, C5, C6, C7, C8, C9, C10, C11, C12, D1, D2, D3, D4, D5, D6, D7, D8, D9, D10, D11, and D12. Fifth ring 160 is situated as a clock face and the numbering of trapezoidal solids E1, E2, E3, E4, E5, E6, E7, E8, E9, E10, E11, and E12 starts at noon. It should be appreciated that the numbering could start anywhere along fifth ring 160. Each trapezoidal solid E1, E2, E3, E4, E5, E6, E7, E8, E9, E10, E11, and E12 represents 30 degrees of fifth ring 160 which is circular. Trapezoidal solids E1, E2, E3, E4, E5, E6, E7, E8, E9, E10, E11, and E12 are formed of a single piece of material and each trapezoidal solid is marked with chamfered channels only on the outermost arcuate surfaces of fifth ring 160.

First trapezoidal projection 162 and second trapezoidal projection 164, as shown in FIG. 2-5, are substantially similar in shape to first and second trapezoidal projections 82, 84, 102, 104, 124, 144, 162, and 164. First trapezoidal projection 162 is fixedly secured to the outermost arcuate side of trapezoidal solid E9. Second trapezoidal projection 164 is fixedly secured to the outermost arcuate side of trapezoidal solid E10. Chamfered edge 163 is shown along the top of the innermost arcuate side of first trapezoidal projection 162. Chamfered edge 165 is shown along the top of the innermost arcuate side of second trapezoidal projection 164.

Each innermost arcuate side of trapezoidal solids A1, A2, A3, A4, A5, A6, A7, A8, A9, A10, A11, A12, B1, B2, B3, B4, B5, B6, B7, B8, B9, B10, B11, B12, C1, C2, C3, C4, C5, C6, C7, C8, C9, C10, C11, C12, D1, D2, D3, D4, D5, D6, D7, D8, D9, D10, D11, D12, E1, E2, E3, E4, E5, E6, E7, E8, E9, E10, E11, and E12 when arranged to form ring-like units 22, 24, 26, 28 and 30 produces a through-bore operatively arranged to stack about post 16. Ring-like units 22, 24, 26, 28 and 30 can be stacked atop or beneath any other ring-like unit. Aside from the arcuate sides of ring-like units 22, 24, 26, 28 and 30 the other surfaces of ring-like units 22, 24, 26, 28 and 30 are planar and smooth having no chamfered edges. The planar surfaces of ring-like units 22, 24, 26, 28 and 30 allow a user of the three-dimensional jigsaw puzzle 10 to freely rotate each ring-like unit 22, 24, 26, 28 and 30 about post 16 without interference from another ring-like unit stacked above or below the ring-like unit to be rotated.

The outermost arcuate sides of first and second trapezoidal projections 82, 84, 102, 104, 124, 144, 162, and 164 are arranged to stack in vertical alignment with the outermost arcuate sides of the curved units of second group of pieces 40 to be discussed in more detail below.

FIG. 3-1 shows first curved unit 42 of second group of pieces 40. First curved unit 42, as all other curved units of the invention, comprises five substantially similar trapezoidal blocks fixedly secured to one another. Each trapezoidal block described herein is identical to trapezoidal projections 82, 84, 102, 104, 124, 144, 162, and 164. In a preferred embodiment, each curved unit comprises a different spatial arrangement of five trapezoidal blocks. However, it should be appreciated that they could have similar spatial arrangements. For purposes of illustration, each spatial arrangement of trapezoidal blocks can be explained by referring to FIG. 3-11 which shows grid G. Grid G represents a coordinate system having five columns and three rows. The five columns of grid G represent the maximum number of columns contained in at least one curved unit. The three rows of grid G represent the maximum number of rows contained in at least one curved unit. The arrangement of the trapezoidal blocks of each curved unit to be described in more detail now can be understood by mapping each trapezoidal block onto a corresponding cell in grid G.

For example, first curved unit 42 comprises five trapezoidal blocks 1-1A, 1-1B, 1-2A, 1-3A, 1-3B. The first "1" indicates the trapezoidal block is part of first curved unit 42. The alphanumeric indicates the cell within grid G which corresponds with the trapezoidal block. First curved unit 42 has three trapezoidal blocks 1-1A, 1-2A, 1-3A which correspond with cells 1A, 2A and 3A in grid G. First curved unit 42 additionally has two trapezoidal blocks 1-1B and 1-3B which correspond with cells 1B and 3B in grid G. When trapezoidal blocks 1-1A, 1-1B, 1-2A, 1-3A, 1-3B are mapped onto grid G into a two-dimensional shape the corresponding cells are "U" shaped.

By way of another example, FIG. 3-2 shows second curved unit 44 of second group of pieces 40. Second curved unit 44 comprises five trapezoidal blocks 2-1A, 2-2A, 2-2B, 2-3A, 2-3B. Like the three trapezoidal blocks 1-1A, 1-2A, 1-3A of first curved unit 42, 2-1A, 2-2A, 2-3A of second curved unit 42 also correspond with cells 1A, 2A, and 3A in grid G. Similarly, like trapezoidal block 1-3B of first curved unit 42, trapezoidal block 2-3B of second curved unit 44 corresponds with cell 3B in grid G. Second curved unit 44 does not have a trapezoidal block that corresponds with cell 1B on grid G as shown within first curved unit 42. Instead, second curved unit 44 comprises trapezoidal block 2-2B which corresponds with cell 2B on grid G.

FIG. 3-3 shows third curved unit 46 of second group of pieces 40. Third curved unit 46 comprises five trapezoidal blocks 3-1A, 3-2A, 3-2B, 3-3B, 3-3C. Trapezoidal blocks 3-1A, 3-2A, 3-2B, 3-3B, 3-3C have an arrangement which corresponds with cells 1A, 2A, 2B, 3B, and 3C on grid G.

FIG. 3-4 shows fourth curved unit 48 of second group of pieces 40. Fourth curved unit 48 comprises five trapezoidal blocks 4-1B, 4-2A, 4-2B, 4-3B, 4-3C which have an arrangement which corresponds with cells 1B, 2A, 2B, 3B, and 3C on grid G.

FIG. 3-5 shows fifth curved unit 50 of second group of pieces 40. Fifth curved unit 50 comprises five trapezoidal blocks 5-1A, 5-2A, 5-2B, 5-2C, 5-3A which have an arrangement which corresponds with cells 1A, 2A, 2B, 2C and 3A on grid G.

FIG. 3-6 shows sixth curved unit 52 of second group of pieces 40. Sixth curved unit 52 comprises five trapezoidal blocks 6-1A, 6-2A, 6-3A, 6-4A, 6-5A which have an arrangement which corresponds with cells 1A, 2A, 3A, 4A, and 5A on grid G.

FIG. 3-7 shows seventh curved unit 54 of second group of pieces 40. Seventh curved unit 54 comprises five trapezoidal blocks 7-1A, 7-2A, 7-3A, 7-3B, 7-4A which have an arrangement which corresponds with cells 1A, 2A, 3A, 3B, and 4A on grid G.

FIG. 3-8 shows eighth curved unit 56 of second group of pieces 40. Eighth curved unit 56 comprises five trapezoidal blocks 8-1A, 8-2A, 8-3A, 8-4A, 8-4B which have an arrangement which corresponds with cells 1A, 2A, 3A, 4A, and 4B on grid G.

FIG. 3-9 shows ninth curved unit 58 of second group of pieces 40. Ninth curved unit 58 comprises five trapezoidal blocks 9-1A, 9-2A, 9-3A, 9-3B, 9-4B which have an arrangement which corresponds with cells 1A, 2A, 3A, 3B, and 4B on grid G.

FIG. 3-10 shows tenth curved unit 60 of second group of pieces 40. Tenth curved unit 60 comprises five trapezoidal blocks 10-1A, 10-2A, 10-2B, 10-2C, 10-3C which have an arrangement which corresponds with cells 1A, 2A, 2B, 2C, and 3C on grid G.

The edges outlining the outermost arcuate sides of the trapezoidal blocks are operatively arranged to abut another outermost arcuate side of another trapezoidal block and such edges are chamfered as described above.

FIG. 4-1 depicts base 12 and first group of pieces 20 stacked on top of and about post 16 upwardly extending from base 12. When ring-like units 22, 24, 26, 28, 30 are stacked in order from first to fifth with first trapezoidal projections 82, 102, 122, 142, 162 in vertical alignment, second trapezoidal projections 84, 104, 124, 144, 164 ascend from low to high in a helical pattern (not shown). When ring-like units 22, 24, 26, 28, 30 are stacked in order from first to fifth but, first trapezoidal projections 82, 102, 122, 142, 162 are not in vertical alignment, second trapezoidal projections 84, 104, 124, 144, 164 ascend from low to high in no particular order. Due to this arrangement, first and second trapezoidal projections 82, 84, 102, 104, 122, 124, 142, 144, 162, 164 protrude in different directions from post 16.

FIG. 4-2 is another perspective of base 12 and first group of pieces 20 where first group of pieces 20 is stacked on top of and about post 16 upwardly extending from base 12. Ring-like units 22, 24, 26, 28, 30 are stacked in order from first to fifth and no trapezoidal projections are vertically aligned. First and second trapezoidal projections 82, 84, 102, 104, 122, 124, 142, 144, 162, 164 protrude radially from post 16 in different directions.

FIG. 4-3 is a top down perspective of base 12 and first group of pieces 20 where first group of pieces 20 is stacked on top of and about post 16 upwardly extending from base 12. Again, ring-like units 22, 24, 26, 28, 30 are stacked in order from first to fifth and no trapezoidal projections are vertically aligned. Rings 80, 100, 120, 140, 160 are vertically aligned. However, trapezoidal projections 82, 84, 102, 104, 122, 124, 142, 144, 162, 164 are not vertically aligned.

Function

The following figures illustrate how a user solves three-dimensional puzzle 10. FIG. 5 shows an attempted solution of three-dimensional puzzle 10 involving at least three layers: first, second and third layers 300, 400, and 500. A user has first stacked second and third ring-like units 24 and 26 on top of and about post 16. Then a user has stacked, in one of several orders, first curved unit 46, second curved unit 44, fifth curved unit 50, and sixth curved unit 52 radially adjacent to second and third ring-like units 24 and 26. In order to stack curved units radially adjacent to ring-like units a user can rotate the ring-like units about post 16. The remaining unused pieces comprise first ring-like unit 22, fourth ring-like unit 28, fifth ring-like unit 30, and third, fourth, seventh, eighth, ninth and tenth curved units 46, 48, 54, 56, 58, 60. A user can stack at least one remaining ring-like unit and at least one curved unit to solve three layer solutions 820, four layer solutions 840, and/or five layer solutions 860.

FIG. 6 shows another attempted solution of three-dimensional puzzle 10 involving at least four layers 300, 400, 500, and 600. A user has first stacked second, third, fourth and fifth ring-like units 24, 26, 28, 30, in one of several orders, on top of and about post 16. Then a user has stacked, in one of several orders, first, second, third, fifth, seventh, and eighth curved units 42, 44, 46, 50, 54 and 56 radially adjacent to first stacked second, third, fourth and fifth ring-like units 24, 26, 28, 30. Again, in order to stack curved units radially adjacent to ring-like units a user can rotate the ring-like units about post 16. The remaining unused pieces comprise first ring-like unit 22 and fourth, sixth, ninth and tenth curved units 48, 52, 58, 60. A user can stack at least one remaining curved unit to solve four layer solutions 840. Additionally, a user can stack all the remaining unused pieces first ring-like unit 22 and fourth, sixth, ninth and tenth curved units 48, 52, 58, 60 to solve five layer solutions 860.

FIG. 7 shows a completed two layer solution 800 comprising two ring-like units (22, 24, 26, 28, 30) and some combination of curved units (42, 44, 46, 48, 50, 52, 54, 56, 58, 60). Two layer solutions 800 comprise first and second layers 300 and 400. Two layer solutions 800 comprise twenty four trapezoidal solids and four trapezoidal projections of the two ring-like units and twenty trapezoidal blocks of the curved units. In a preferred embodiment there are twenty three (23) different ways of completing a two layer solution 800.

FIG. 8 shows a completed three layer solution 820 comprising three ring-like units (22, 24, 26, 28, 30) and some combination of curved units (42, 44, 46, 48, 50, 52, 54, 56, 58, 60). Three layer solutions 820 comprise first, second and third layers 300, 400 and 500. Three layer solutions 820 comprise thirty six trapezoidal solids and six trapezoidal projections of the three ring-like units, and thirty trapezoidal blocks of the curved units. In a preferred embodiment there are two thousand two hundred and ninety four (2,294) different ways of completing a three layer solution 820.

Figures 1, 3:
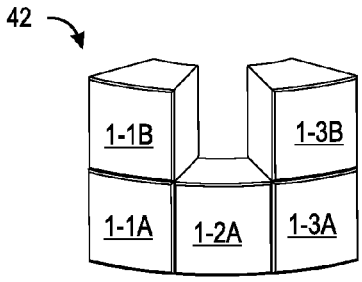
Figures 3, 4, 5, 6, 7, 8, 9, 10, 11:
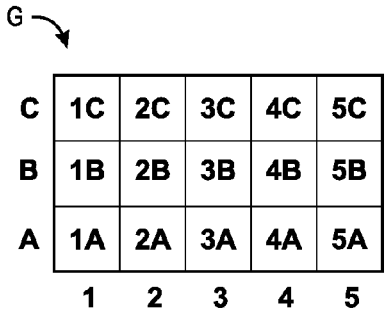
Figures 2, 3:
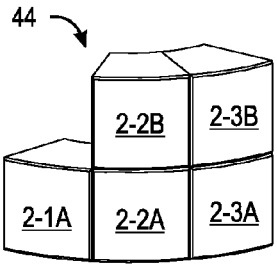
Figure 3:
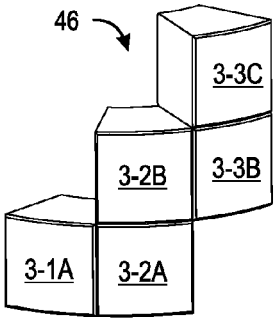
Figures 3, 4:
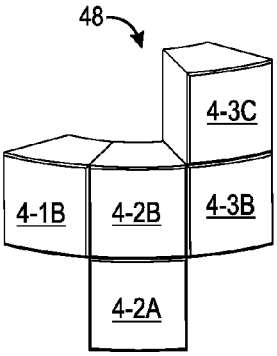
Figures 3, 4, 5:
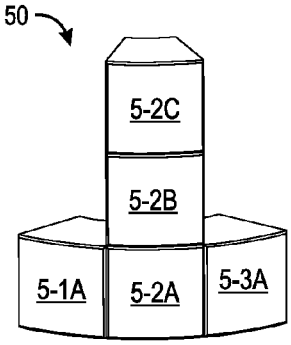
Figures 3, 4, 5, 6:
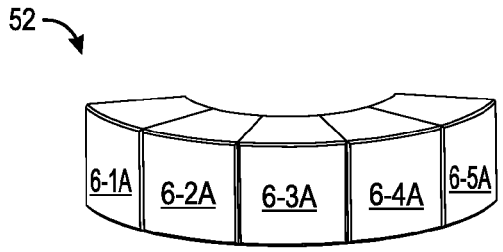
Figures 3, 4, 5, 6, 7:
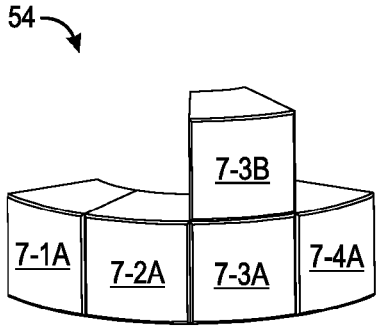
Figures 3, 4, 5, 6, 7, 8:
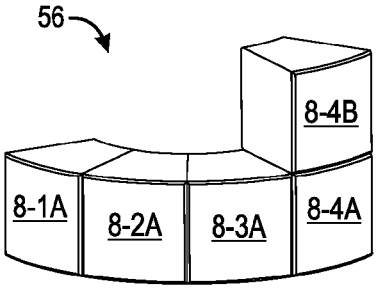
Figures 3, 4, 5, 6, 7, 8, 9:
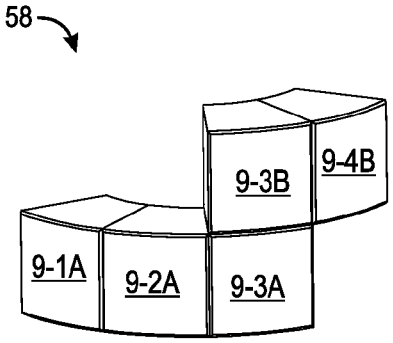
Figures 3, 4, 5, 6, 7, 8, 9, 10:
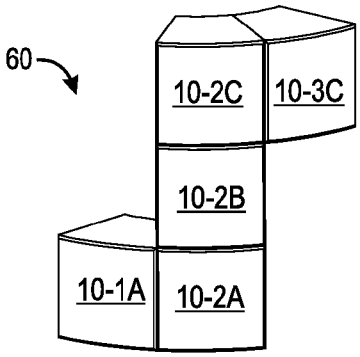
Figures 2, 4:
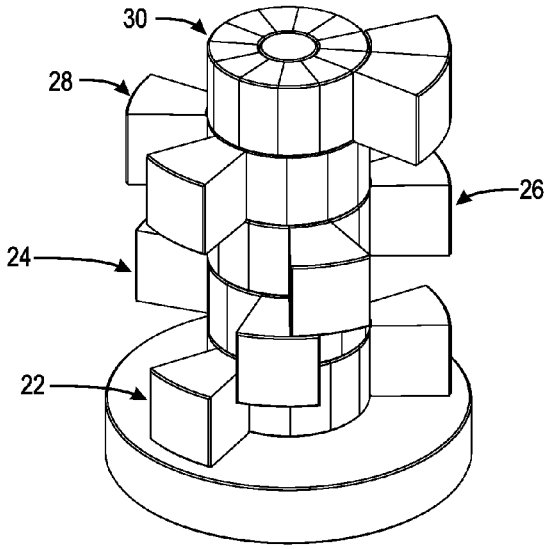
Figures 1, 4:
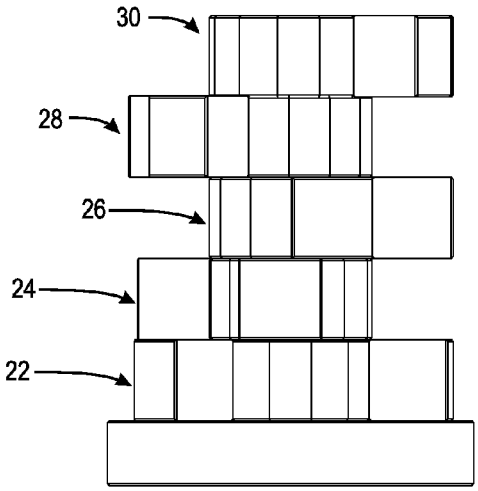
Figures 3, 4:
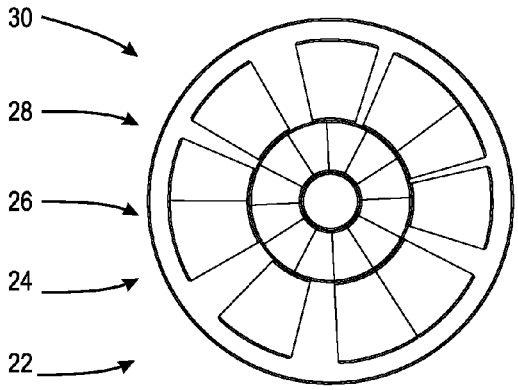
Figure 5:
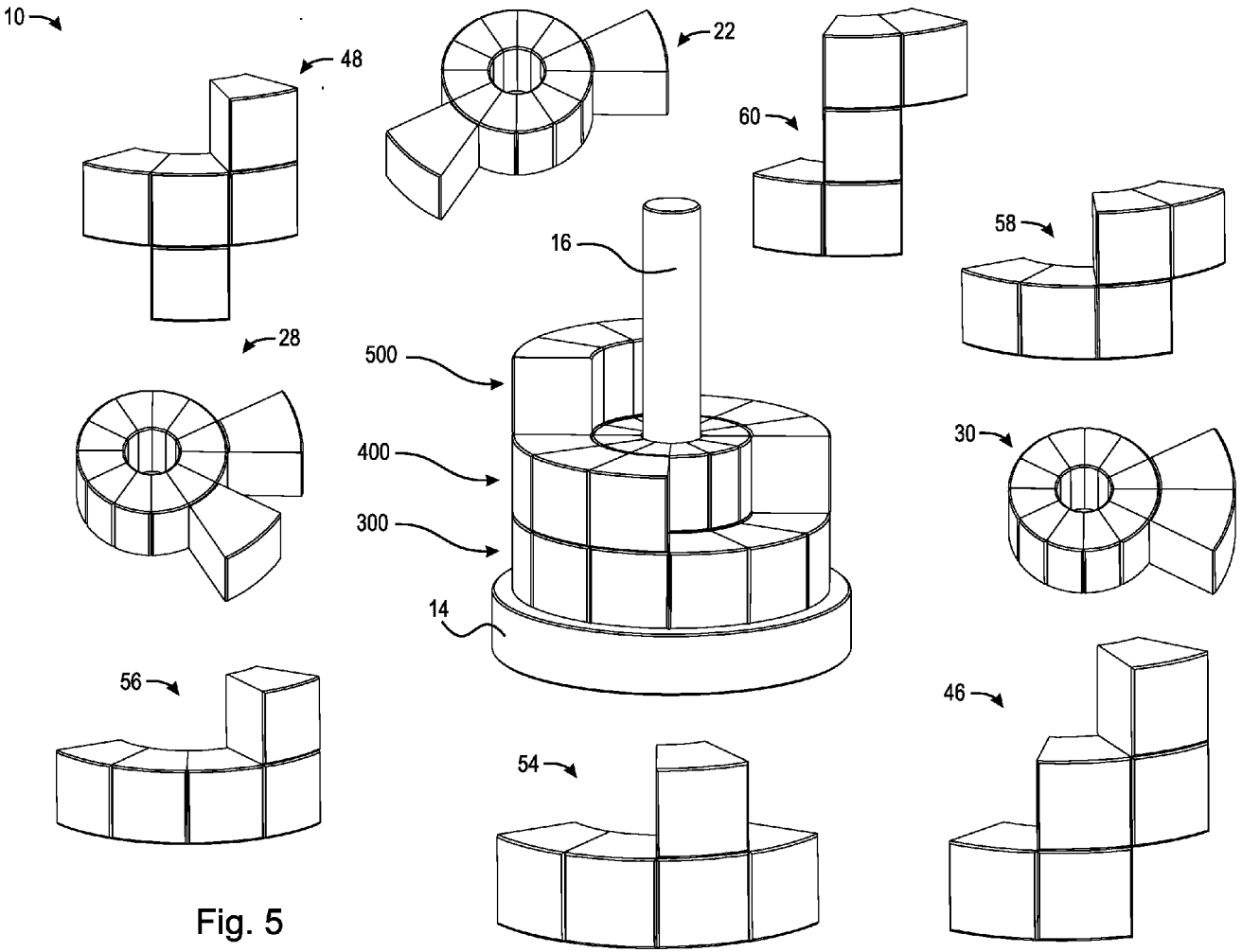
Figure 6:
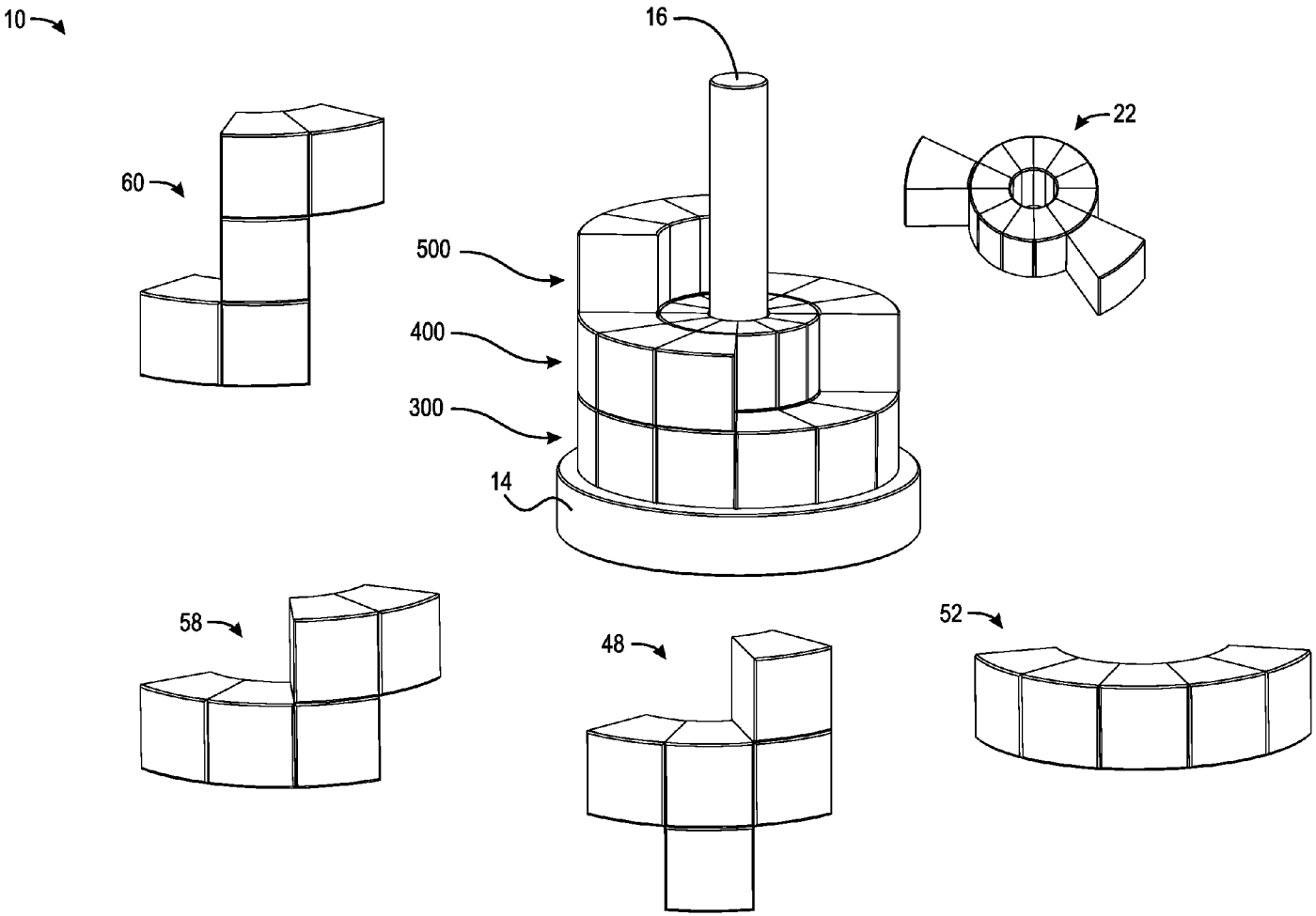
Figure 7:
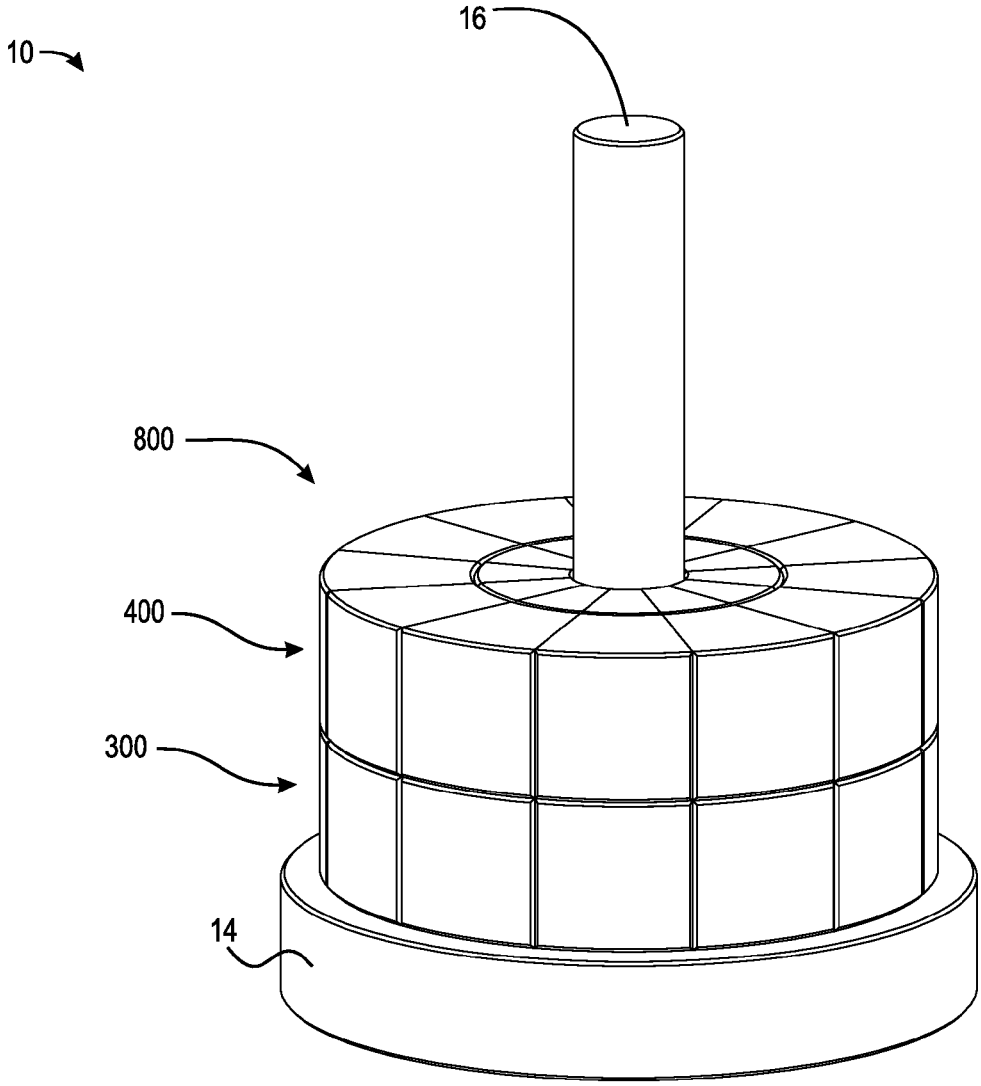
Figure 8:
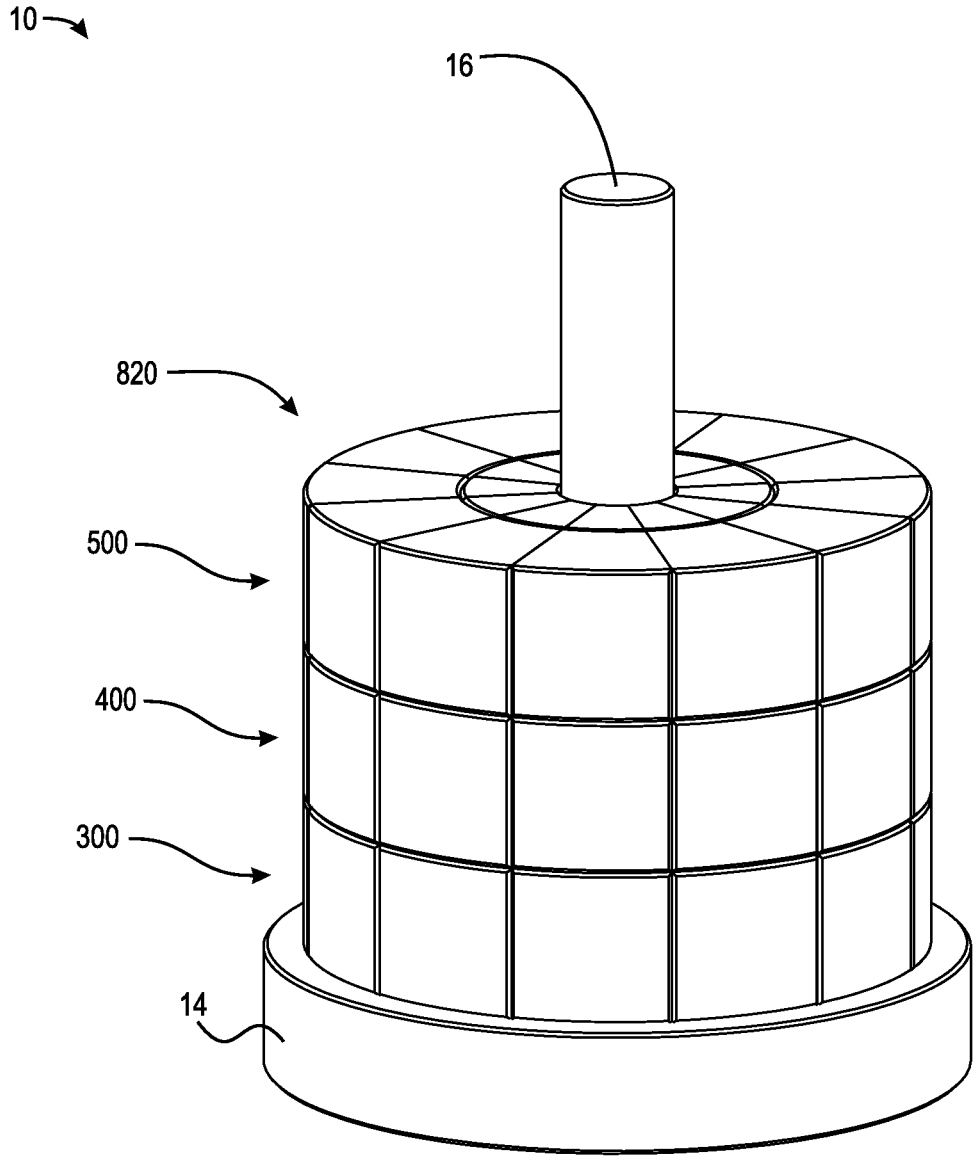
Figure 9:
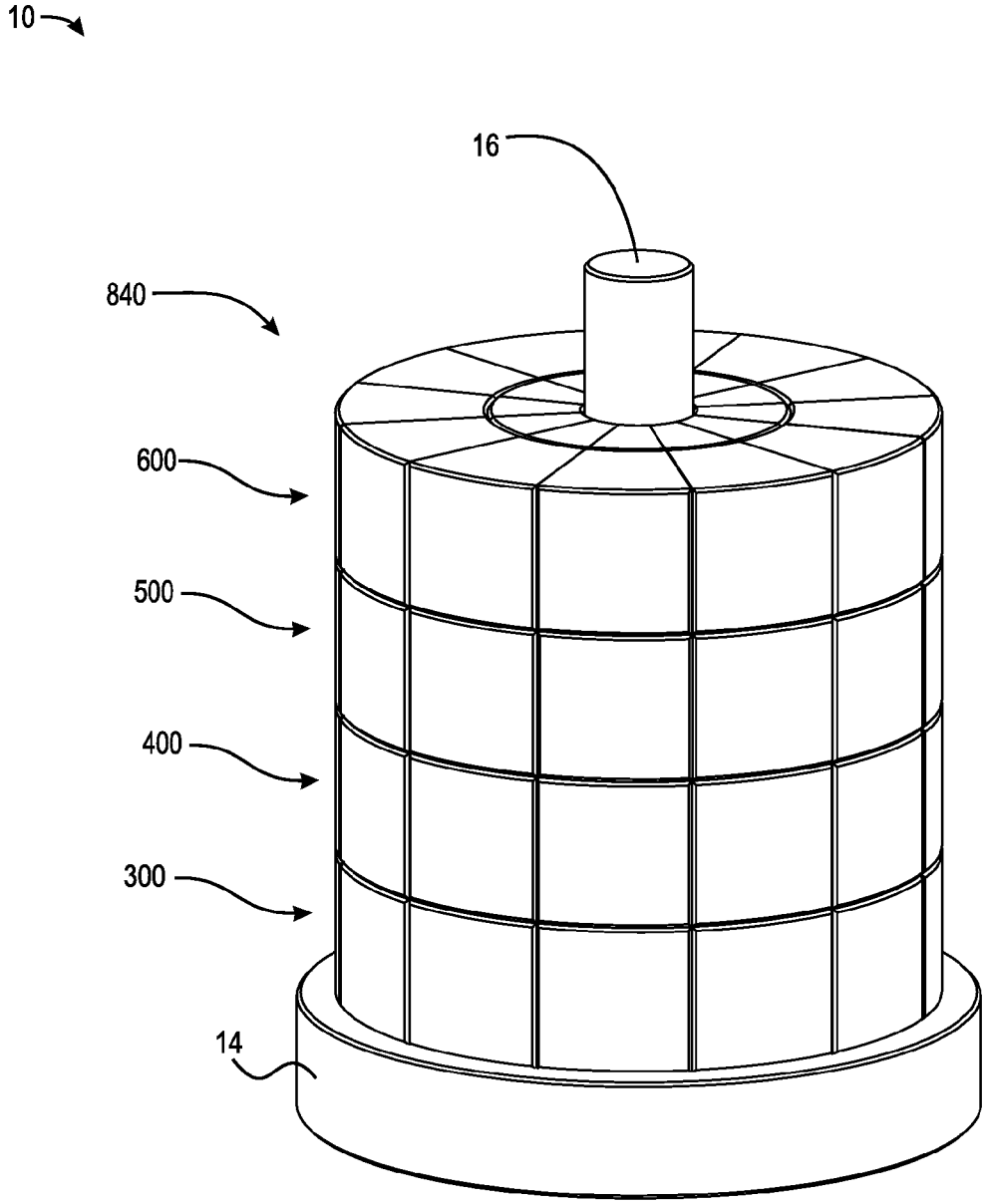
Figure 10:
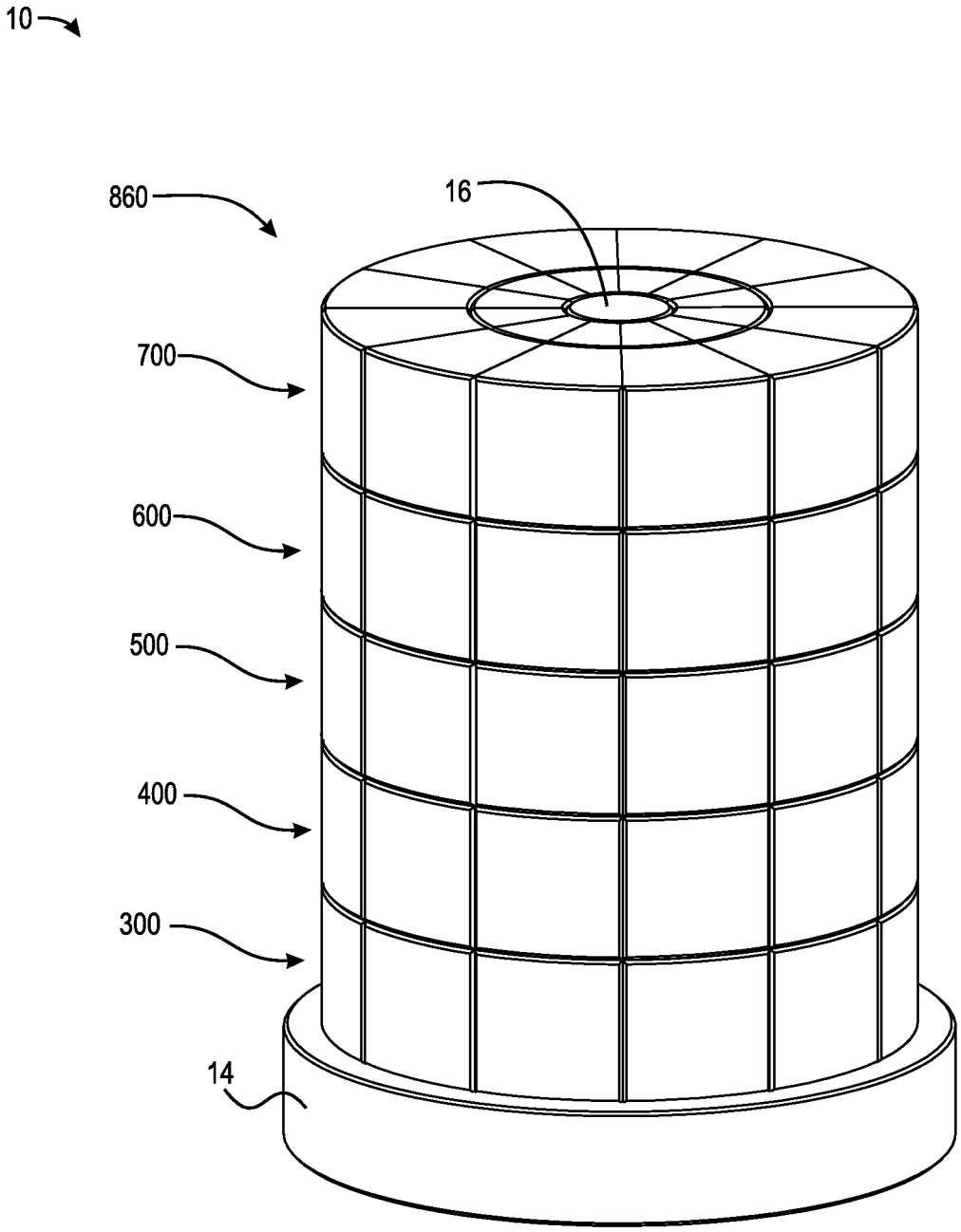

FIG. 9 shows a completed four layer solution 840 comprising four ring-like units (22, 24, 26, 28, 30) and some combination of curved units (42, 44, 46, 48, 50, 52, 54, 56, 58, 60). Four layer solutions 840 comprise first, second, third and fourth layers 300, 400, 500, and 600. Four layer solutions 840 comprise forty eight trapezoidal solids and eight trapezoidal projections of the four ring-like units, and forty trapezoidal blocks of the curved units. In a preferred embodiment there are thirteen thousand five hundred and eighty eight (13,588) different ways of completing a four layer solution 840.

FIG. 10 shows a completed five layer solution 860 comprising all five ring-like units (22, 24, 26, 28, 30) and all ten curved units (42, 44, 46, 48, 50, 52, 54, 56, 58, 60). Five layer solutions 860 comprise first, second, third, fourth, and fifth layers 300, 400, 500, 600, and 700. In a preferred embodiment there are six thousand one hundred and sixty four (6,164) different ways of completing a five layer solution 860.

In the preferred embodiment shown and described there are a total of twenty two thousand and sixty nine (22,069) possible different solutions including two, three, four and five layer solutions 800, 820, 840, and 860 and excluding 507,587 duplicates. Duplicates are considered to be reflected or inverted versions of one and the same solution. In order to build cylindrical solutions having more layers than the two layer solutions 800, i.e., three, four and five layer solutions 820, 840 and 860, a user must stack additional ring-like and curved units. It should be appreciated that the ring-like units and curved units can be modified to be more or less complicated. For example, curved units 42, 44, 46, 48, 50, 52, 54, 56, 58, 60 could be modified to each comprise four trapezoidal blocks, or fewer trapezoidal blocks. Similarly, it should be appreciated that three-dimensional puzzle 10 can be modified to have additional levels or any number of levels. Color and grooves or indentations can also be used to facilitate or complicate the complexity of solving three-dimensional puzzle 10.

Thus, it is seen that the objects of the present invention are efficiently obtained, although modifications and changes to the invention should be readily apparent to those having ordinary skill in the art, which modifications are intended to be within the spirit and scope of the invention as claimed. It also is understood that the foregoing description is illustrative of the present invention and should not be considered as limiting. Therefore, other embodiments of the present invention are possible without departing from the spirit and scope of the present invention.

What is claimed is:

1. A three-dimensional jigsaw puzzle, comprising:

a base;

a post fixedly secured to and emanating upwardly from said base;

a first group of pieces, each of said pieces in said first group having a through-bore therein to enable stacking about said post and also having at least one radially extending projection in a shape of a trapezoidal solid, each of said pieces in said first group further including a top surface and a bottom surface, each of which is substantially planar; and, a second group of pieces, each of said pieces in said second group having at least one radially extending projection in the shape of a trapezoidal solid;

wherein said first and second groups of pieces are operatively arranged to stack with one another to form a cylindrically shaped structure.

2. The jigsaw puzzle recited in claim 1 wherein each of said pieces in said first group of pieces includes a plurality of units which are substantially similar in shape.

3. The jigsaw puzzle recited in claim 1 wherein each of said pieces in said second group of pieces includes a plurality of units which are substantially similar in shape.

4. The jigsaw puzzle recited in claim 1 wherein said first and second groups of pieces comprise a plurality of trapezoidal solids.

5. The jigsaw puzzle recited in claim 1 wherein said cylindrically shaped structure has no gaps.

6. A three-dimensional jigsaw puzzle, comprising:

a base;

a post fixedly secured to and emanating upwardly from said base;

a first group of pieces consisting of two pieces each having a through-bore therein to enable stacking about said post and also having at least one radially extending projection in a shape of a trapezoidal solid and a top surface and a bottom surface which are substantially planar; and, a second group of pieces, each of said pieces in said second group of pieces having at least one radially extending projection in the shape of a trapezoidal solid; wherein said two pieces of said first group of pieces and said second group of pieces are operatively arranged to stack with one another to form a cylindrically shaped structure.

7. The jigsaw puzzle recited in claim 6 wherein each of said pieces of said first group of pieces includes a plurality of units which are substantially similar in shape.

8. The jigsaw puzzle recited in claim 6 wherein each of said pieces of said second group of pieces includes a plurality of units which are substantially similar in shape.

9. The jigsaw puzzle recited in claim 6 wherein said first and second groups of pieces are made of a plurality of trapezoidal solids.

10. The jigsaw puzzle recited in claim 6 wherein said cylindrically shaped structure has no gaps.

11. A three-dimensional jigsaw puzzle, comprising:

a base;

a post fixedly secured to and emanating upwardly from said base;

a first group of pieces consisting of three pieces each having a through-bore therein to enable stacking about said post and also having at least one radially extending projection in a shape of a trapezoidal solid and a top surface and a bottom surface which are substantially planar; and, a second group of pieces, each of said pieces in said second group of pieces having at least one radially extending projection in the shape of a trapezoidal solid; wherein said first group of pieces and said second group of pieces are operatively arranged to stack with one another to form a cylindrically shaped structure.

12. The jigsaw puzzle recited in claim 11 wherein each of said pieces of said first group of pieces includes a plurality of units which are substantially similar in shape.

13. The jigsaw puzzle recited in claim 11 wherein each of said pieces of said second group of pieces includes a plurality of units which are substantially similar in shape.

14. The jigsaw puzzle recited in claim 11 wherein said first and second groups of pieces are made of a plurality of trapezoidal solids.

15. The jigsaw puzzle recited in claim 11 wherein said cylindrically shaped structure has no gaps.

16. A three-dimensional jigsaw puzzle, comprising:

a base;

a post fixedly secured to and emanating upwardly from said base;

a first group of pieces consisting of four pieces each having a through-bore therein to enable stacking about said post and also having at least one radially extending projection in a shape of a trapezoidal solid and a top surface and a bottom surface which are substantially planar; and, a second group of pieces, each of said pieces in said second group of pieces having at least one radially extending projection in the shape of a trapezoidal solid; wherein said first group of pieces and said second group of pieces are operatively arranged to stack with one another to form a cylindrically shaped structure.

17. The jigsaw puzzle recited in claim 16 wherein each of said pieces of said first group of pieces includes a plurality of units which are substantially similar in shape.

18. The jigsaw puzzle recited in claim 16 wherein each of said pieces of said second group of pieces includes a plurality of units which are substantially similar in shape.

19. The jigsaw puzzle recited in claim 16 wherein said first and second groups of pieces are made of a plurality of trapezoidal solids.

20. The jigsaw puzzle recited in claim 16 wherein said cylindrically shaped structure has no gaps.

21. A three-dimensional jigsaw puzzle, comprising:

a base;

a post fixedly secured to and emanating upwardly from said base;

a first group of pieces consisting of five pieces each having a through-bore therein to enable stacking about said post and also having at least one radially extending projection in a shape of a trapezoidal solid and a top surface and a bottom surface which are substantially planar; and, a second group of pieces, each of said pieces in said second group of pieces having at least one radially extending projection in the shape of a trapezoidal solid; wherein said first group of pieces and said second group of pieces are operatively arranged to stack with one another to form a cylindrically shaped structure.

22. The jigsaw puzzle recited in claim 21 wherein each of said pieces of said first group of pieces includes a plurality of units which are substantially similar in shape.

23. The jigsaw puzzle recited in claim 21 wherein each of said pieces of said second group of pieces includes a plurality of units which are substantially similar in shape.

24. The jigsaw puzzle recited in claim 21 wherein said first and second groups of pieces are made of a plurality of trapezoidal solids.

25. The jigsaw puzzle recited in claim 21 wherein said cylindrically shaped structure has no gaps.

26. The jigsaw puzzle recited in claim 21 wherein said second group of pieces includes ten pieces.

* * * * *